US006585265B2

(12) United States Patent
Dewa et al.

(10) Patent No.: US 6,585,265 B2
(45) Date of Patent: Jul. 1, 2003

(54) BOARD GAME PLAYED BY PLURAL PLAYERS AND METHOD OF PLAY THEREOF

(75) Inventors: Shoji Dewa, Tokyo (JP); Akihiro Takatoku, Tokyo (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 10/099,433

(22) Filed: Mar. 15, 2002

(65) Prior Publication Data

US 2003/0042675 A1 Mar. 6, 2003

Related U.S. Application Data

(60) Provisional application No. 60/316,551, filed on Aug. 31, 2001.

(51) Int. Cl.[7] ..... A63F 3/00

(52) U.S. Cl. ..... 273/243; 273/146; 273/275; 273/285

(58) Field of Search ..... 273/236, 275, 273/276, 287, 285, 146, 260, 261, 243

(56) References Cited

U.S. PATENT DOCUMENTS 3,359,657 A 12/1967 Hedberg
3,940,142 A 2/1976 Hinz et al.
4,190,256 A * 2/1980 Rudden, Jr. ..... 273/275
4,801,147 A * 1/1989 Miller ..... 273/236
4,813,678 A * 3/1989 Collazo et al. ..... 273/146
4,892,319 A * 1/1990 Johnson, II ..... 273/146

FOREIGN PATENT DOCUMENTS

DE 8705084.6 6/1988
EP 1136103 A2 * 9/2001 ..... A63F/00/00

* cited by examiner

*Primary Examiner*—Benjamin H. Layno
*Assistant Examiner*—Vishu K Mendiratta
(74) *Attorney, Agent, or Firm*—Pearne & Gordon LLP

(57) ABSTRACT

A board game in which a game can be developed in an unexpected way can be provided. Plural dice selected from among plural dice which can be unfolded two-dimensionally are rolled. According to the results of the rolling of the dice, a die is unfolded and placed on the play field. On the unfolded dice a player places his/her piece. Also according to the results of the rolling of the dice, a player saves costs necessary for pursuing a game on an Addition/Deduction Unit. On the cards respectively corresponding to pieces, the Group, Level, Ability etc. of the pieces are indicated. A player makes his/her piece advance or attack the opponent's piece by paying the saved costs, and at the same time makes his/her piece defend itself by paying the saved costs as well. A player who succeeds in giving pre determined damage to a specific piece of the opponent wins a game.

31 Claims, 10 Drawing Sheets

BOARD GAME PLAYED BY PLURAL PLAYERS AND METHOD OF PLAY THEREOF

We hereby claim the benefit under 35 U.S.C. Sec. 119(e) of U.S. provisional patent application Serial No. 60/316,551 filed Aug. 31, 2001, entitled "BOARD GAME AND BOARD GAME METHOD OF PLAY".

BACKGROUND OF THE INVENTION

This invention relates to a board game played by plural players and the method of play thereof.

In some of conventional board games in which plural players play against their opponents, pieces of each player are initially set on a play filed on which the advancing path patterns of the pieces are depicted. The plural players in turn advance their pieces along the advancing path according to the rules of the game. When a player's piece gets in a predetermined positional relationship with a piece(s) of the opponent(s), the player eliminates the opponent's (opponents') piece(s) from the play field (or from the board) according to the predetermined power of each of his/her piece.

In the conventional board games as mentioned above in which pieces are just moved along the predetermined advancing path(s), the advancing paths are limited to certain alternatives and it is difficult for the game to develop in an unexpected way. It is also difficult for the game to develop in an unexpected way when the game is played with pieces which only possess given predetermined power. In addition, when a game is played with predetermined pieces, players' interest in the game tends to wither in an early stage of the game. Furthermore, in the conventional board games, development of the game is often carried out only by advancing pieces and no other factors are involved in the development of the game. Therefore in the conventional board games players' strategies are inevitably simple, therefore it is difficult for players' strategic interest to culminate until player's piece and the opponent's (opponents') piece(s) start fighting. As a result, it was not easy in the conventional board games to give fun of working out a strategy in the game to the players in the initial stage of the game. Also in the conventional board games, conditions for wielding or exerting power of each piece is simple, and naturally the development of the game is simple, so it has been difficult for a dramatic development of the game such as one decisive attack to upturn the fighting condition to take place.

SUMMARY OF THE INVENTION

The present invention has been made in view of the foregoing disadvantage of the prior art.

Accordingly, it is an object of the present invention to provide a board game and method of play there of which is capable of providing a game with unexpected development and giving more satisfaction than the conventional board games.

It is another object of the present invention to provide a board game and method of play thereof in which advancing path pattern of each piece varies everytime players play the game.

It is still another object of the present invention to provide a board game and method of play thereof in which the fun of elaborating strategies in the game increases in the development of the game.

It is yet another object of the present invention to provide a board game and method of the play thereof in which costs (charges) necessary for playing the game can be easily saved in the development of the game.

It is a further object of the present invention to provide a board game and the method of play thereof in which the degree of damage of each piece can be easily recognized.

It is another object of the present invention to provide a board game and the method of play thereof in which player's own game components and those of the other player's (players') can be identified surely.

It is still another object to provide a board game and method of play thereof in which unexpected development of the game can be realized by providing a rule that each piece cannot attack or defend without paying necessary costs (charges) while the piece is originally given certain power to wield or exert.

It is yet another object of the present invention to provide a board game and the method of play thereof in which unused pieces and the pieces which have turned out to be considered as destroyed in the development of the game are instantly distinguished.

It is a further object of the present invention to provide a board game and method of play thereof in which players can prepare their selected pieces freely from among various pieces and establish different strategies based on the pieces.

The board game of the present invention comprises a play field having a plurality of polygonal grids which extend continuously and a plurality of game component sets used by a plurality of players for the play thereof. Play field may be made with any material such as paper or board, as far as it is in a form of a sheet. The shape of polygonal grids may be triangle, square or pentagon, etc. Generally it is preferable that the grid is in a shape of regular polygon as the unfolded die is placed on the play field, which step will be described in the following. Also predetermined grids on the play field whose number equals to that of the possible players are depicted differently from the rest of the grids. For example those grids may be colored differently from the rest of the grids for identifying purpose. By providing such easily identifiable grids, the initial placement of the unfolded die can be regulated in various ways according to the rules with such identifiable grids as the guide.

The game component set includes a plurality of dice, a plurality of pieces having visually identifiable features and belonging to predetermined plural groups and/or predetermined plural levels and a plurality of cards corresponding to each piece which respectively show identification of the piece, capacity (special power, effect, etc.), conditions in which power within capacity can be wielded or exerted, and group and/or level the piece belongs to.

First of all a die consists of a polyhedron having n (n is an integer which is 3 or more) polygonal plates which have the substantially same shape and dimension with the grids of the play field and are connected with one another. The die of polyhedron can be unfolded in the present invention. Each of the n polygonal plates is connected to specific adjacent polygonal plates in such a manner that each of said n polygonal plates is so as to be connected to those specific adjacent polygonal plates when the die (polyhedron) is unfolded two-dimensionally. N polygonal plates consisting a die may be formed integrally with synthetic resin material. In this instance joining portions where two adjacent plates are joined and connecting portions and connected portions which are used to fix up a die may also be integrally formed with synthetic resin material. A die may also be formed with a foldable sheet such as paper.

On the outside of the dice, a plurality of marks are depicted. Those marks include Die-Unfolding Mark which is a decisive factor for unfolding a die, Advancement Mark which permits saving a cost (or a charge) necessary for advancing a piece, more than one (1) Execution Marks which permits saving a cost (or a charge) necessary for wielding or exerting power of a piece and more than one (1) Identification Marks which show the group and/or level to which a piece belongs to. The above mentioned more than one (1) Execution Marks may include Attack Mark which permits saving a cost (or a charge) for attacking (one of powers of each piece), Defense Mark which permits saving a cost (or a charge) for defending (one of powers of each piece) and more than one (1) Special Ability Marks which permit saving a cost (or a charge) for wielding or exerting a predetermined special ability by a piece. These Die-Unfolding Mark, Advancement Mark, Execution Mark and Identification Mark may be depicted with at least one of the factors of color, figure, pattern, symbol or letter. By combining these factors, it is possible to depict more marks on the outside of a polygon. As a result, it is possible to depict a Die-Unfolding Mark, an Advancement Mark and more than 2 selected marks from Execution Marks and Identification Marks on the outside of a polygon. Therefore by rolling a small number of dice, players can enjoy a wide variety of alternatives. When a plurality of marks are depicted on the outside of a polygon, the size of the marks are arbitrary. One mark may be depicted inside another mark if both are identifiable from each other. Also beside one mark, another mark may be depicted in a smaller size as an accompanying letter or mark.

Powers of a piece include, for example, attacking power, defending power, special power of wielding or exerting a predetermined attacking or defending power, power to form a way of escape, power to entrap, power to mine, etc.

It is preferable to depict a Position Mark on inside of at least one of n polygonal plates which mark shows a position where a piece is placed. With such a Position Mark it is possible to place a piece on a specific polygonal plate when a rule for the initial position of a piece is made. In addition if the Position Mark is arranged in such a manner that a player can write on the Position Mark for the player to identify the die as his or hers, the player can easily collect his/her dice looking for the writing on the Position Mark.

A piece comprises a base which is placed on the play field and a featuring portion which is set on the base and capable of showing the direction. If such pieces are integrally formed with synthetic resin material, pieces can be made in a large quantity at a low cost. The featuring portion may be in any shape as far as the front and rear sides can be identified. The featuring portions of course may be in a figure of animal, man, imaginary animal (monster), etc. Especially when the figure of an animal is used for a piece, it is easily understood that the direction the animal is facing is the front without making any regulations as to the direction of a piece. Also the piece may have a shape which features the capacity (of power) of the piece. It is preferable to provide a piece with a portion on which a player can write to identify his/her piece. With such writing on each piece, the player can easily collect his/her pieces after the game.

Among the pieces which are featured by the descriptions on cards corresponding to respective pieces, there are attacking target-type pieces having defending power, attacking power and sustaining power and effect-demonstrating type pieces which only have predetermined effects. For example, on a card for an attacking-target type piece, defending power, attacking power, and sustaining power are indicated with numerals and/or volume. Also costs which are necessary for wielding or exerting such powers are shown. Defending power means a capacity or power of a piece which power is deducted from the opponent's attacking power to weaken the attacking power of the opponent's piece. Sustaining power means a power which can sustain the existence of a piece until the numeral thereof becomes zero (0) by the attacking power of the opponent being deducted from the sustaining power after the defending power of the piece has become zero (0). As all these numerals are indicated on each card, each player can enjoy the game using plural pieces without memorizing all powers of each piece. It is preferable also to depict, on each card corresponding to a piece, Execution Mark necessary for a piece to demonstrate the ability thereof. With this indication, each player need not memorize the necessary cost for demonstrating an ability of a piece and the player can pursue the game smoothly. In addition, each piece need not be given all of Attacking Power, Defending Power and Sustaining Power. Sustaining Power may be set at zero (0), or the three powers (Attacking Power, Defending Power and Sustaining Power) may all be set at zero (0) and Special Ability or Special Effect may be given to a piece to wield, exert or demonstrate instead.

It is preferable to include in a game component set an Addition/Deduction Unit having plural Addition/Deduction Display portions corresponding to Advancement Mark and more than one (1) Execution Marks. With this Addition/Deduction Unit a player need not memorize or write down the numeral (point) of each mark or increase or decrease of cost of each mark but can record surely such numeral (point) or increase or decrease of cost. Thus the development of the game is speedy. It is preferable for the Advancement Mark, Attack Mark, Defence Mark and more than one (1) Special Ability Marks to be depicted adjacent to Addition/Deduction Display portions of the Addition/Deduction Unit. With such indication players can add or deduct points speedily without being puzzled.

It is also preferable to include in a game component set plural marbles (chip-like parts) which are shaped like candy drops and can be placed on a card. These marbles can indicate to the players the decrease of Sustaining Power of a specific piece by placing on a card such number of the marbles as corresponds to the actual decrease of Sustaining Power during the game. Thus the game development is carried out smoothly.

In the method of play of the present invention players can pursue the game using the above mentioned board game according to specific rules. In these rules each player has his/her turn in order and in each turn each player carries out the following steps (a)–(f).

(a) Die-Rolling Step—Each player chooses plural dice from among his/her dice in his/her game component set and roll those dice on a dice rolling place.

(b) Die-Unfolding Step—When a Die-Unfolding Mark is respectively included among the judgement objects depicted on the outside of the polygonal plates of the predetermined number of dice, each player will unfold (or open up) two-dimensionally a die having a Die-Unfolding Mark and place the unfolded die on a play field to cover n grids which are connected to one another.

(c) Piece-Placement Step—Each player chooses, according to the group and/or level recognized from the plural dice rolled on a play field, one piece from among pieces he/she owns in his/her game component set. Each player then places the piece on one of the polygonal plates constituting said unfolded die.

(d) Cost-Saving Step—Both when a die is unfolded and when not, each player can save the number of marks, whether they may be Advancement Marks and/or Execution Marks when such marks are included among the judgement objects depicted on the outside of the polygonal plates of dice. Each player save the number of marks which appeared as costs for each mark.

(e) Advancement/Attack Step—Each player advances a piece on the play field and/or make a piece wield or exert power to attack or destroy one of the opponent's pieces by paying the predetermined cost from among the saved costs.

(f) Closing-Step—Each player ends his/her turn after carrying out Advancement Step and/or Attack Step or without carrying out those steps.

Each player in order executes the above steps and the unfolded dice will form an advancing path pattern for pieces. Also in each turn each player can save costs for making his/her pieces used for fighting to wield or exert power. When a piece stands on an advancing path pattern and a player owns costs saved for making the piece wield or exert power thereof, the player can advance his/her piece or execute other actions. Therefore each player can enjoy the game by advancing his/her piece or, in some cases, by making the piece demonstrate specific ability or power thereof even before the fighting between the player's piece and that of the opponent's starts.

When a rule is set as a player can defend his/her piece and also attack and destroy the opponent's piece by paying the costs even during the opponent's turn, each player can fight against his/her opponent demonstrating the ability or power of his/her piece placed on the play field to the full extent.

A Master Piece which is the proxy of a player may be included among various pieces classified into plural groups and levels in a game component set. When a Master Piece is included in a game, it is preferable for the Master Piece to be placed on the play field from the beginning of the game. In this instance it is preferable that a specific grid on which the Master Piece is placed should be arranged to be easily distinguished from other grids. Deciding the capacity or power of the Master Piece is arbitrary. For example, the lower the capacity or power of the Master Piece, the more important the strategy for defending the Master Piece in a game becomes, and a player can have more fun in elaborating his/her strategy for the game.

By deciding steps which should be taken during a turn as mentioned above, each player is, in a series of actions, supposed to select a die to be unfolded, to form an advancing path pattern with the unfolded die, to select a piece, to save cost necessary for pursuing the game and to decide whether or not it is necessary to advance his/her piece or attack the opponent's piece therewith by paying the cost and carry out his/her decision. In this instance, the development of a game varies greatly depending on a combination of plural decisions during one turn. Therefor each player can change his/her strategy for the game enjoying the selections during each turn, which will enable unexpected development of the game as compared to the conventional board games and will give more satisfaction to players. Moreover in the present invention, a die is unfolded to form an advancing path pattern. Such advancing path pattern will vary in each game, therefor the game development will naturally be different in each game. Thus players can enjoy the game for longer period of time in comparison with other conventional board games.

Especially when a rule is set forth so that as a player can defend his/her piece and attack or destroy the opponent's piece by paying the necessary cost for such an action during the opponent's turn for advancement and attack steps, the player can have a real-time fight against the opponent. In this instance a speedy game development can be realized as other fighting games, even if a turn include a plurality of actions of selection for a player.

The rule need not specifically regulate how an unfolded die should be placed on the play field. However, by regulating this point, working out a strategy becomes more difficult. For example, a rule may be set forth as at the first Piece-Placement Step each player is required to place his/her unfolded die to cover at least one grid which is adjacent to the grid on which his/her Master Piece is placed. In the following Die-Unfolding Steps each player is required to place his/her unfolded die not to overlap the already-placed unfolded die and yet to place his/her unfolded die to cover at least one of the grids adjacent to the grids which are covered by the already-placed unfolded die. In this instance each player can save necessary costs until his/her dice touch his/her opponents dice, thus the game can be developed smoothly.

In another rule setting, each player may advance his/her piece along an advancing path pattern formed by unfolded dice in order and when his/her piece gets in a predetermined positional relationship with the opponent's piece, the player is allowed to attack the opponent's piece or the opponent's Master Piece. In this instance, although the attacking conditions are limited to certain extent, players can fight against opponents while saving costs (even with a small amount of costs saved).

As for the winning or losing of a piece, the rule may be set forth as, for example, a piece under attack whose Sustaining Power is decreasing because of the opponent's piece whose Attacking Power surpasses the piece's Defending Power is regarded as destroyed when its Life Power goes down to zero (0). In this arrangement one fight between a player's piece and that of the opponent usually does not end up in a winning or loosing of a piece, therefore players can enjoy the game for a relatively long time using even a small number of pieces. Furthermore the rule may be set forth that a piece is placed on the corresponding card until the piece is placed on an unfolded die placed on the play field. When a player's piece is destroyed in a game (has lost in a fight against the opponent's piece), the rule may set forth that the corresponding card of the piece is turned over and the piece is placed on the turned-over card or the piece is laid on the card. In such arrangement it is clear to players which pieces can be used and which cannot. Also players can pursue the game recognizing the pieces the opponents have and enjoy a fair game.

While the numbers of the plural dice and the pieces of plural kinds are fixed to the regulated numerals according to the rule, it is preferable for each player to be able to choose plural dice and pieces of plural kinds from his/her own stock. In this instance, from the point of choosing dice and pieces from the stock, the strategy formation starts and strategic variation increases. Players also will have more fun in increasing a stock.

Winning or losing may be decided within a discretion of players. However, when Master Pieces are used, the rule may be set forth as follows. When a Master Piece has incurred a predetermined amount of damage, the owner of the Master Piece is determined to have lost the game. In this instance, not only attacking but also defending is a significant factor of strategy and players can enjoy the game fully.

DETAILED DESCRIPTION OF PREFERRED EMBODIMENTS

Referring to the attached drawings, the board game and the method of play thereof in an actual game situation will be described in detail in the following.

Figure 1:
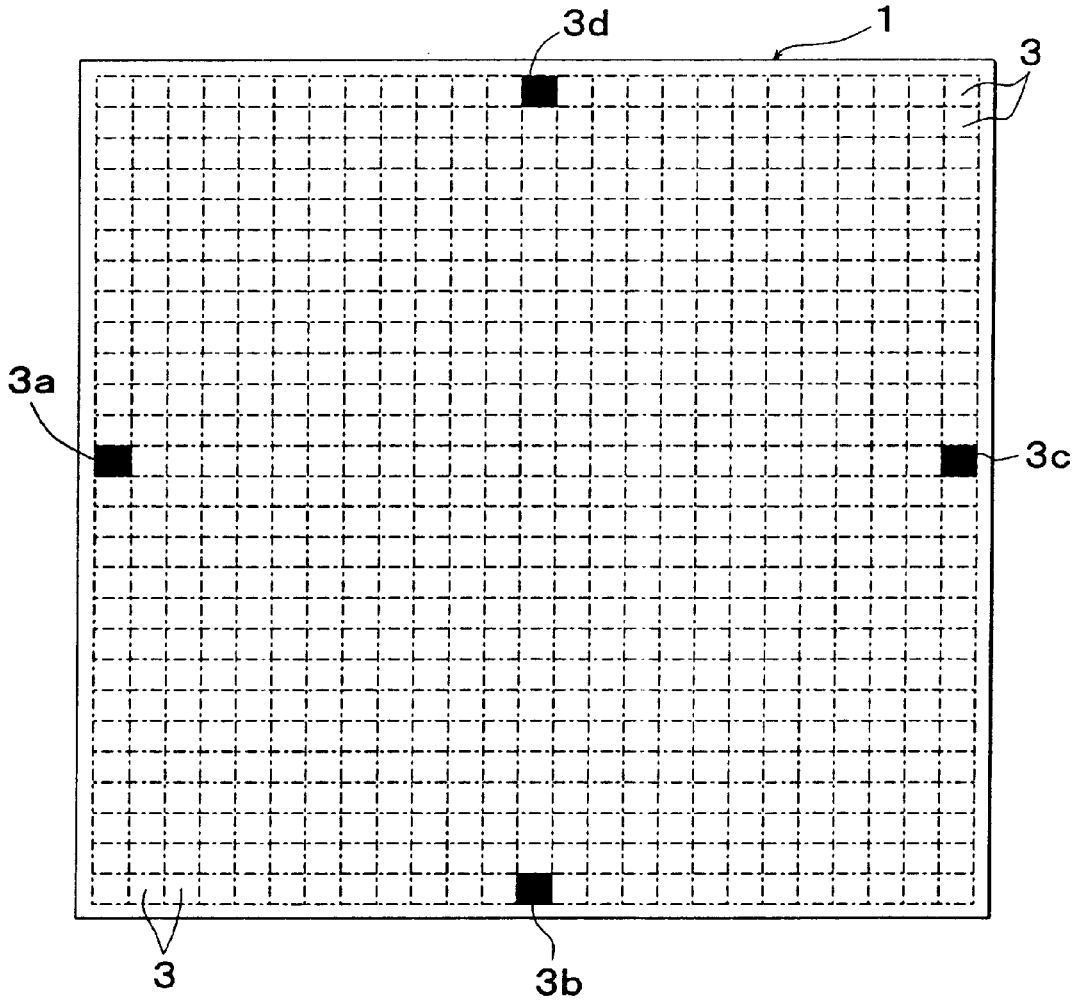
FIG. 1 is a plan view of an example of the play field used in the board game in the present invention.

The board game in the present invention comprises a play field 1 having a plurality of polygonal grids extending continuously and a game component set used by each of plural players for their own play. The play field 1 as shown in FIG. 1 is for the maximum of four (4) players and may be formed with paper, vinyl sheet, wooden board, sheet of synthetic resin, etc. On the play field 1 a plurality of the polygonal grids (square in this case) are depicted to form a matrix. In this embodiment, four (equal number to the number of players) grids 3*a*–3*d* of the grids 3 of the play field are colored differently from the rest of the grids 3 to make them distinguishable. The distinguishable grids 3*a* and 3*c* and 3*b* and 3*d* are placed across from each other respectively. These distinguishable grids 3*a*–3*d* are the places for each player to place his/her respective Master Piece at the beginning of the game and also the guide for placing an unfolded die (which will be described in the following) on the play field.

Figure 8A:
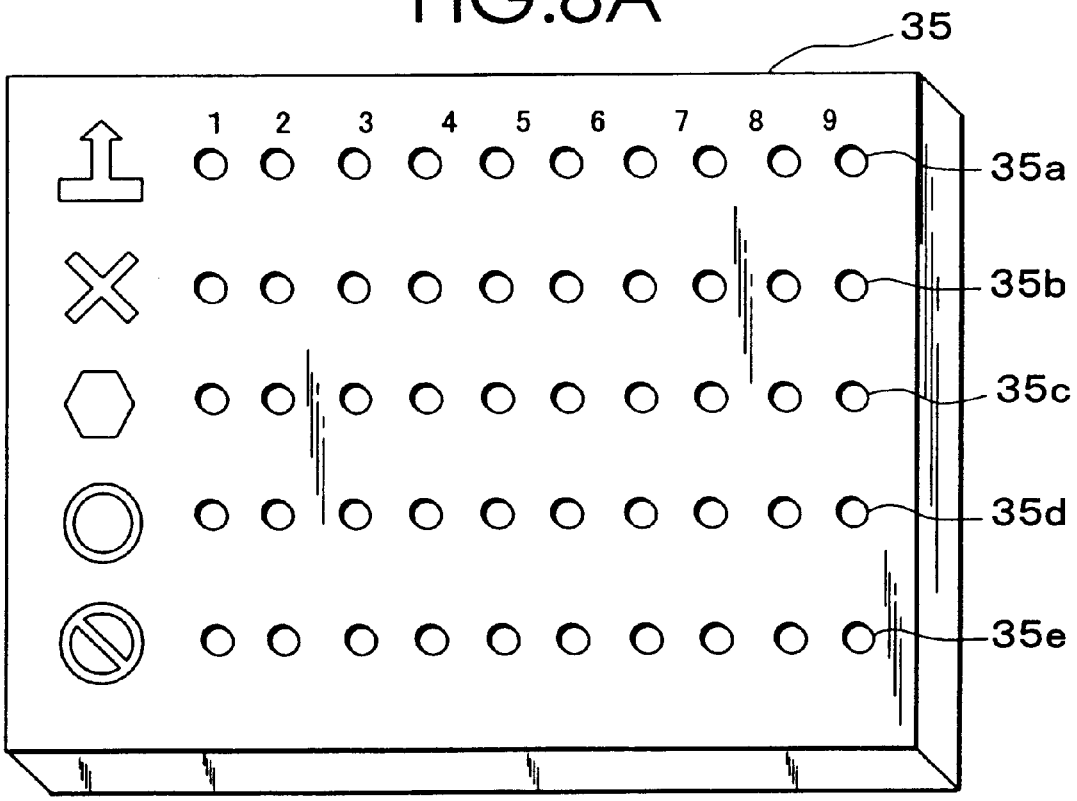
FIGS. 8A and 8B are perspectives of an example of the Addition/Deduction Unit.
Figure 8B:
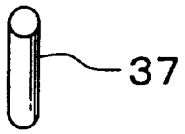
Figure 9:
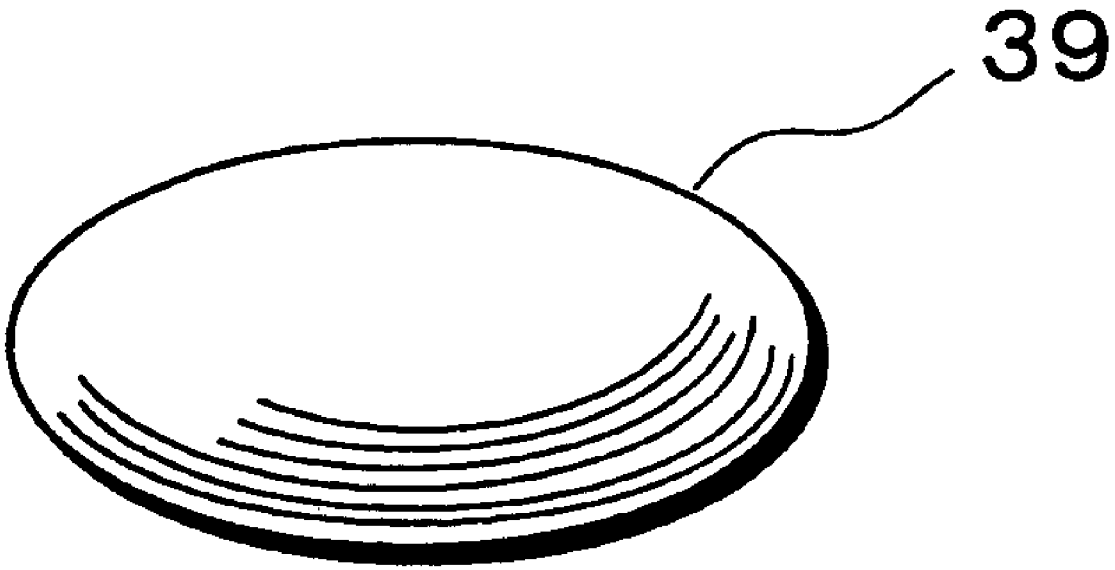
FIG. 9 is a perspective of an example of the marble.

The game component set used in this embodiment comprises a plurality of dice 5 as described later with reference to FIGS. 2, 3A–3C, 4A–4F, and 5A–5D, a plurality of pieces 25*a*–25*d* as described later with reference to FIGS. 5, 6A–6D, a plurality of cards 33 corresponding to pieces as described later with FIG. 7, an Addition/Deduction Unit for costs shown in FIGS. 8A and 8B, and a plurality of marbles 39 as shown in FIG. 9.

Figure 3A:
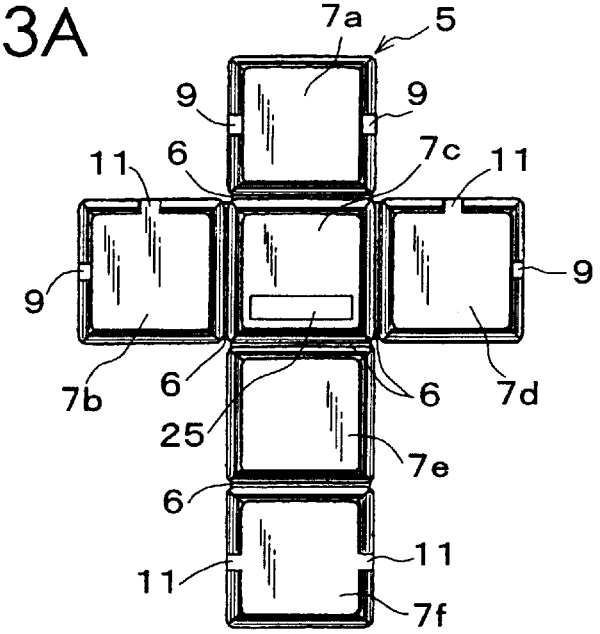
FIGS. 3A–3C show inside and outside of a die unfolded to show an example of unfolding a die.
Figure 3B:
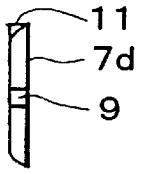
Figure 3C:
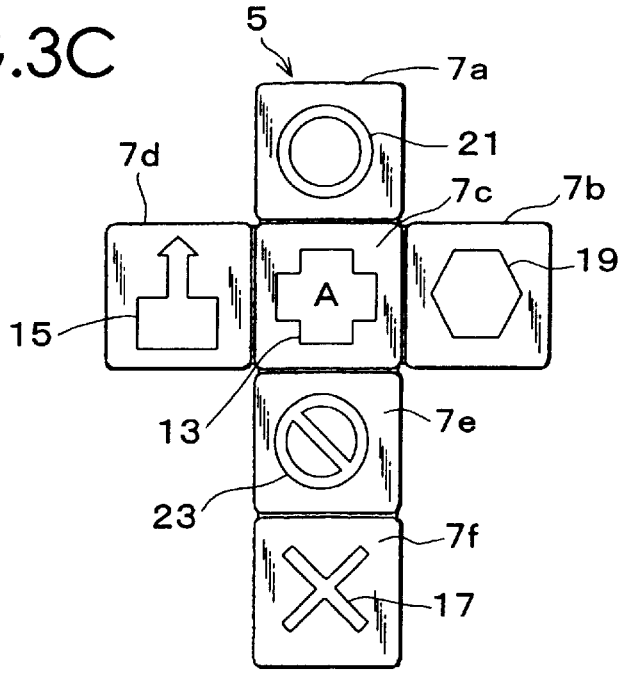
Figure 4A:
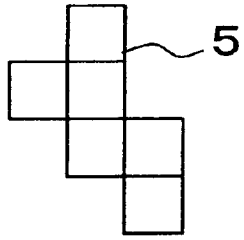
FIGS. 4A–4F are schematic views showing different examples of unfolded dice.
Figure 4B:
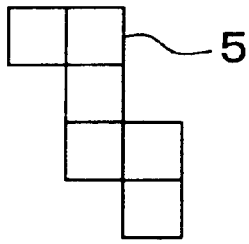
Figure 4C:
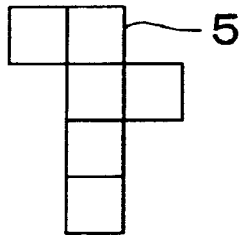
Figure 4D:
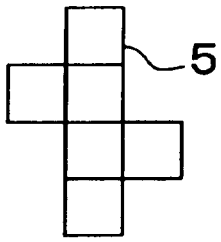
Figure 4E:
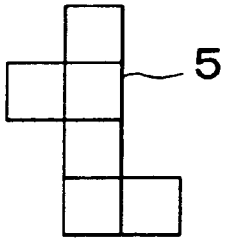
Figure 4F:
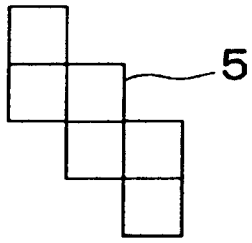
Figure 5A:
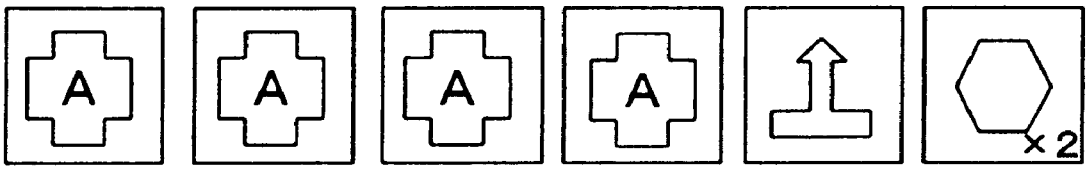
FIGS. 5A–5D respectively show examples of marks depicted on the polygonal plates constituting dice.
Figure 5B:
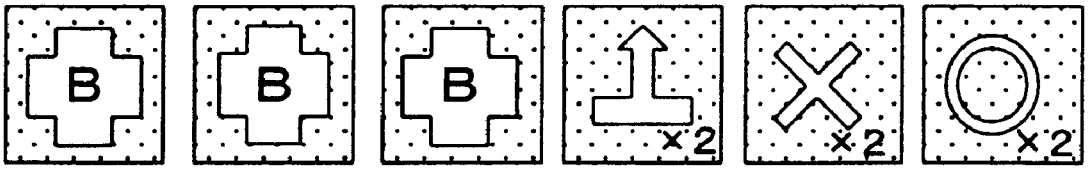
Figure 5C:
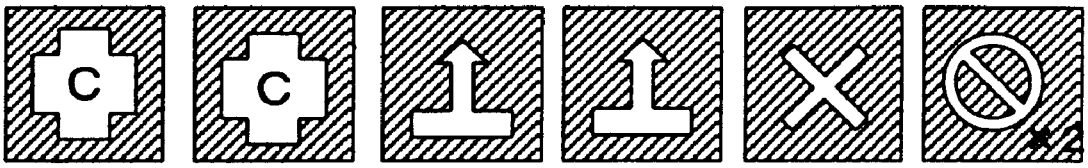
Figure 5D:
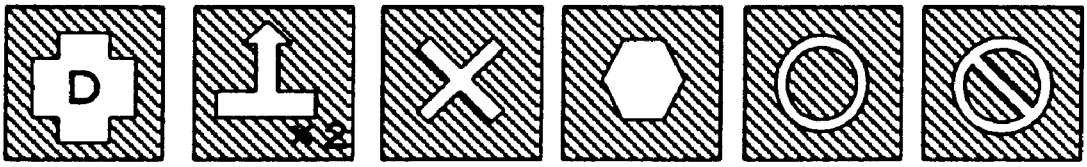

FIGS. 3A and 3C show the inside and outside of an unfolded die. A die 5 is a hexahedron with six (6) polygonal plates 7*a*–7*f* (square plates in this instance) which has the substantially same contour and dimensions with the polygonal grids 3. The six (6) polygonal plates of the die can be unfolded and therefore each of the six (6) polygonal plates are connected to specific adjacent polygonal plate(s) in such a manner that when the die is unfolded two dimensionally each polygonal plate is connected to that specific adjacent polygonal plate(s). The six polygonal plates 7*a*–7*f* constituting a die are formed integrally with synthetic resin. In this instance the joining portions 6 for joining adjacent polygonal plates and connecting portions 9 and connected portions 11 which are used for fixing up a die may be also formed integrally with synthetic resin material. As shown in FIG. 3B each of connected portions 11 consists of a cavity whose cross sectional shape is substantially a rectangle and each of connecting portions 11 consists of a projection which is forced in the cavity constituting the connected portion 9. By forcing a connecting portion 11 in a corresponding connected portion 9, a die is fixed up in such a manner to enable unfolding the die. It should be noted here that the structure of connecting portions and connected portions are not limited to examples shown in the drawings.

Figure 2:
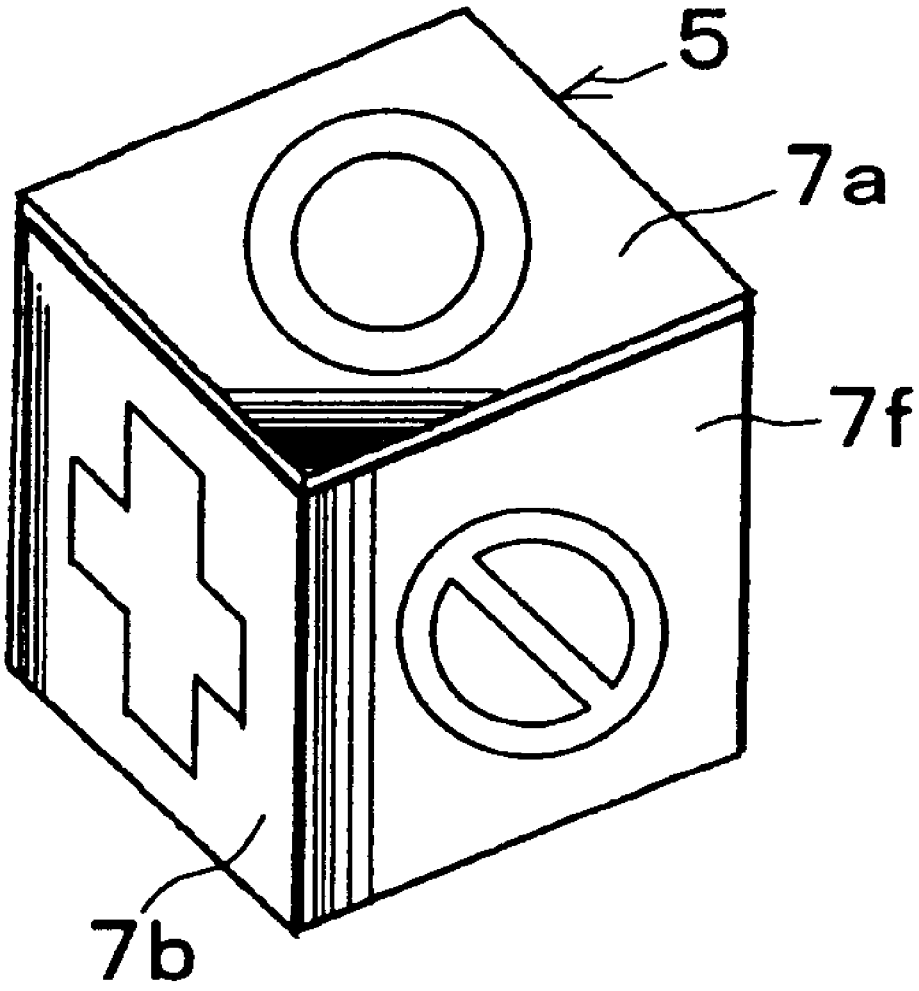
FIG. 2 is a perspective of an example of the dice used in the board game in the present invention.

As shown in the FIGS. 2 and 3C, the following marks are depicted on the outside of the polygonal plates 7*a*–7*f* constituting a die. The marks are one (1) Die-Unfolding Mark 13 which is the decisive factor for unfolding a die, one (1) Advancement Mark 15 which indicates that a player can save a necessary cost for advancing a piece and four (4) Execution Marks 17–23 which indicate respectively that a player can save a necessary cost for demonstrating ability or power of a piece. Attacking Mark 17 indicates that a player can save a cost necessary for attacking (one of the capacity or powers given to a piece), and Defending Mark 19 which indicates that a player can save a cost necessary for defending (one of the capacity or powers given to a piece) and the two Special Ability Marks 21 and 23 indicate respectively that a player can save a cost necessary for making his/her piece to demonstrate a predetermined special ability or power of the piece. Also in this instance the Group (one of the Identification Marks) to which a piece belongs is shown by the color of the polygonal plates 7*a*–7*f* constituting a die. The Level (one of the Identification Marks) of a piece is indicated by an alphabetical symbol depicted inside a Die-Unfolding Mark.

On the inside of the polygonal plate 7*c*, one of the six (6) polygonal plates 7*a*–7*f* constituting a die 5, a Position Mark 25 for placing a piece when the die is unfolded is depicted. The Position Mark is a seal on which letters can be written with a ball-point pen or a felt-tip pen. Plural Position Marks may be attached to plural polygonal plates constituting a die so that a player may have increased opportunities for deciding a position for placing his/her piece.

The unfolding pattern of a die is not limited to the kind shown in FIGS. 3A–3C. FIGS. 4A–4F show different patterns of unfolded dice. One game component may include one kind of dice having one kind of unfolded pattern, or plural kinds of dice having plural kinds of unfolded patterns.

FIGS. 5A–5D show some combinations of marks depicted on the outside of the dice used in a game. FIGS. 5A–5D show an example of the kinds of marks depicted on the six (6) plates of a die 5. From FIG. 5A to FIG. 5D, the number of Die-Unfolding Marks shown is decreasing. If a player chooses a die like that shown in FIG. 5A, the player will have more chances to unfold a die but the player will have less chances to save necessary costs as described in the following. On the contrary, if a player uses a die like FIG. 5D, the player has fewer chances to unfold a die but have more chances to save costs. Players are required to decide which dice to use in each of his/her turn considering such characteristics of the dice. In addition the numbers which are written near some marks show that the marks with such number may be saved as much as the number. It goes without saying that other letters or symbols may be written alongside each mark.

FIGS. 6A–6D show an example of plural pieces 25*a*–25*d* which have visually identifiable features and belong to predetermined Groups and Levels. These pieces 25*a*–25*d* comprise respectively a base 27 and a feature portion 29 which are formed on the base and show the direction of the pieces. The pieces are formed integrally with synthetic resin material and the surfaces of the pieces are painted. On the feature portion of each piece two eyes are depicted to show the front and the rear sides. The feature portion may of course have a figure of an animal, a man, an imaginary animal (monster), etc. The base 27 is provided with a writing portion 31 by which a player can be identified. These writing portions 31 are also seals on which players can write his/her name or other things with pens. With these writing portions it is possible for a player to collect his/her own pieces looking for the writing on the writing portions as the guide after a game is over.

Figure 7:
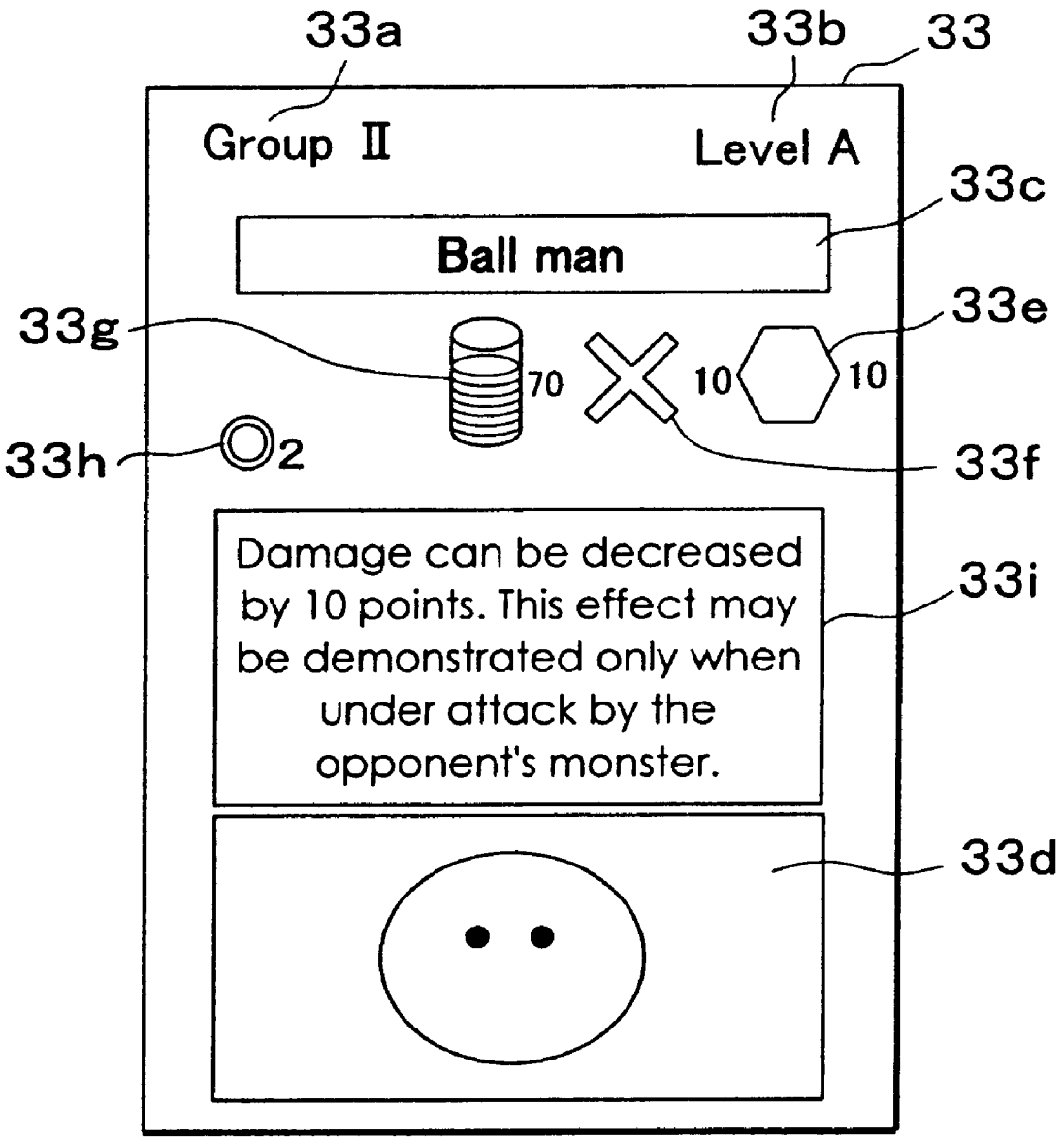
FIG. 7 shows an example of the descriptions shown on a card.

FIG. 7 shows an example of the front side of a card 33 produced corresponding to a piece such as piece 25*a*, one of plural kinds of pieces, to indicate the denomination for identifying the piece, the capacity of the piece (special ability or power, effect, etc.), conditions for demonstrating such capacity and the Group and the Level of the piece. Each piece such as 25*a* and others is featured by the writings on the card 33 corresponding to each piece. Plural kinds of pieces such as 25*a* and others include attacking object-type pieces provided with Defending Power, Attacking Power and Sustaining Power and effect demonstrating-type pieces demonstrating predetermined effects to opponents' pieces. Each piece is classified into different groups and yet the piece is given a certain Level which shows the degree of the capacity of the piece. Therefore, as described in the following, a player is required to choose a piece of such a Level that is decided by the rolling of dice from among the pieces of such Group that is decided by the rolling of the dice.

In this instance the capacity of the piece includes for example ability or power to attack, ability or power to defend, ability or power to conduct predetermined special attack or defense, ability or power to form a way of escape, ability or power to entrap, ability or power to mine, etc.

Figure 6A:
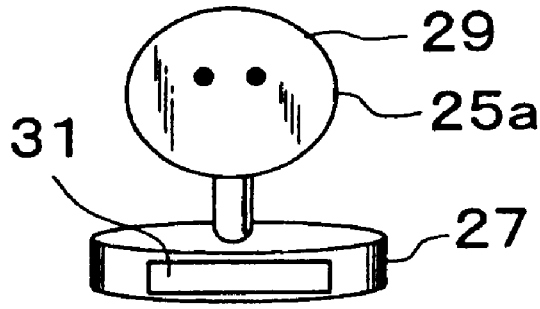
FIGS. 6A–6D show examples of pieces.
Figure 6B:
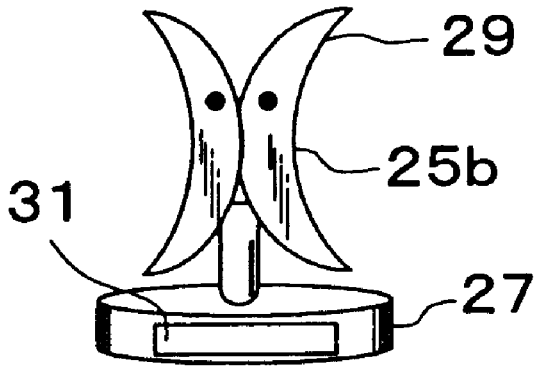
Figure 6C:
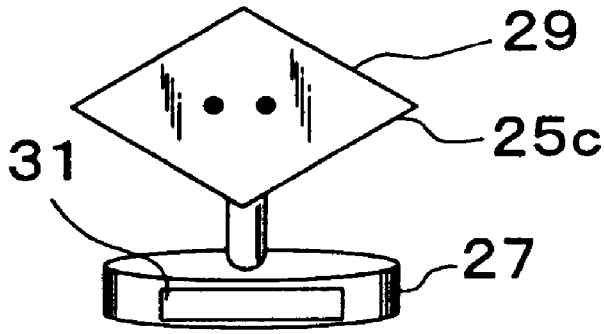

The piece 25*a*, as shown in FIG. 6A, is an attacking object-type piece. On a card corresponding to the piece it is shown that the Group 33*a* to which the piece belongs is "Group II", that the Level 33*b* to which the piece belongs is "Level A", and that the Name 33*c* of the piece is "Ball man." On the card corresponding to the piece the Picture 33*d* of the piece is also shown. Furthermore it is shown on the card that the Attacking Power of the piece is 10 points, Defending Power 40 points, and Sustaining Power 70 points. These "Powers" are shown with respective marks 33*e*–33*g* thereof and numerals. And yet the cost which is necessary for demonstrating the Special Ability or Power of the piece is shown with a numeral and an Execution Mark 33*h* which indicates the kind of cost. The Content 33*i* of the Special Power which can be demonstrated by paying the cost is also shown.

The "Defending Power" means the power to weaken the "Attacking Power of an opponent's piece" by deducting the numeral of the "Defending Power" from the figure of the "Attacking Power of the opponent's piece." On the contrary, the "Attacking Power" means the power to weaken the "Defending Power of an opponent's piece" by deducting the numeral of the "Attacking Power" from the numeral of the "Defending Power of the opponent's piece." Moreover the "Sustaining Power" means the power which sustain a piece to exist in a game until the Sustaining Power becomes zero (0) by the numeral of Attacking Power of the opponent's piece being deducted from the figure of the Sustaining Power, after the Defending Power of the piece has become zero (0). With descriptions of these powers written on each card corresponding to each piece, each player can enjoy a game without having to memorize all the powers of each piece particularly.

Figure 6D:
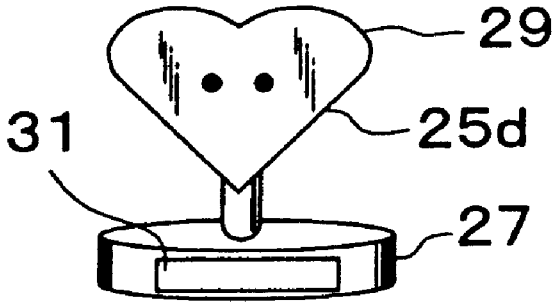

In this instance a Master Piece, a piece shown in FIG. 6D, which serves as a proxy of a player is included among plural kinds of pieces in a game component set. This Master Piece is placed on the above-mentioned distinguishable grid from the beginning of the game. It is arbitrary to decide the power of the Master Piece. The lower the powers of the Master Piece are set, it becomes more important to plan a strategy for defending the Master Piece in a game, which will give more fun to a player in elaborating a strategy. In this instance the Master Piece is given just Attacking Power and the Defending Power, which is described on a card corresponding to the Master Piece.

While not shown in FIGS. 6A–6D, pieces may include such an effect demonstrating-type of piece as a mine which destroys a piece coming across the place thereof (coming across the grid on which the mine is placed). However, in a basic organization of pieces, it is not necessary to include such effect demonstrating-type of pieces. The cards are of course prepared for the effect demonstrating-type of pieces.

FIG. 8A shows an Addition/Deduction Unit included in a game component set. The Addition/Deduction Unit has five (5) Addition/Deduction Display portions 35*a*–35*e* corresponding to an Advancement Mark and four Execution Marks. This Addition/Deduction Unit is integrally formed with synthetic resin and has Addition/Deduction Display portions respectively having 10 holes on the surface. By inserting such pins as shown in FIG. 8B and by changing the position of the pins to be inserted, addition or deduction of costs is indicated. Next to Addition/Deduction Display portions 35*a*–35*e,* Advancement Mark, Attack Mark, Defense Mark and more than one (1) Special Power Marks are depicted. With these Addition/Deduction Unit 35, a player can surely record addition or deduction of points for each mark without having to memorize or write down. An Addition/Deduction Unit 35 shown in FIGS. 8A and 8B is an example and the Addition/Deduction Unit is not limited thereto. For example, pins 37 need not be used but other things equivalent to such pins may be prepared for an Addition/Deduction Unit, which uses those substitutions for addition or deduction by changing the positions of those things.

FIG. 9 shows a perspective of one of a plurality of marbles 39 included in a game component set. It is enough if there are eight (8) or ten (10) marbles for a game. During a game the decrease of the Sustaining Power of a piece can be shown to players by placing, on a card, the number of marbles corresponding to the decreased amount of Sustaining Power.

An example of the method of play of the above mentioned board game between two players according to the present invention will be described in the following with reference to FIG. 10. According to the method of play of the present invention, a game will develop according to the rules using the above mentioned board game. In prior to the game each player places his/her own Master Piece on the grids 3*a*, 3*c*. Also each player puts his/her own cards on a place which is next to the play field and which the opponent can see. And each player puts his/her pieces onto the corresponding cards. Furthermore, the Addition/Deduction Unit 35 as shown in FIGS. 6A–6D is also placed on a position which the opponent can see. In this instance the pattern of the unfolded dice used in this game are not limited to one pattern but are in various patterns as shown in FIGS. 4A–4F.

Each player then has a turn in order. The rule then sets forth that each player will conduct the following steps (a)–(f) in each turn.

(a) Die-Rolling Step—Each player chooses plural dice from among his/her dice in his/her game component set and roll those dice on a dice rolling place.

(b) Die-Unfolding Step—When a Die-Unfolding Mark is respectively included among the judgement objects depicted on the outside of the polygonal plates of the predetermined number of dice, each player will unfold (or open up) two-dimensionally a die having a Die-Unfolding Mark and place the unfolded die on a play field to cover n grids which are connected to one another.

(c) Piece-Placement Step—Each player chooses, according to the group and/or level recognized from the plural dice rolled on a play field, one piece from among pieces he/she owns in his/her game component set. Each player then places the piece on one of the polygonal plates constituting said unfolded die.

(d) Cost-Saving Step—Both when a die is unfolded and when not, each player can save the number of marks, whether they may be Advancement Marks and/or Execution Marks when such marks are included among the judgement objects depicted on the outside of the polygonal plates of dice. Each player save the number of marks which appeared as costs for each mark.

(e) Advancement/Attack Step—Each player advances a piece on the play field and/or make a piece wield or exert power to attack or destroy one of the opponent's pieces by paying the predetermined cost from among the saved costs.

(f) Closing-Step—Each player ends his/her turn after carrying out Advancement Step and/or Attack Step or without carrying out those steps.

In this instance each player chooses three dice from among his/her dice 5. Then each player will roll dice onto a rolling place (usually a floor or desktop on which the play field is placed). In this rolling step, when a Die-Unfolding Mark is respectively included among the judgement objets on the outside of the polygonal plates 7*a*–7*f* of the two (2) dice out of the three (3) dice rolled, each player will unfold (or open up) two-dimensionally a die having a Die-Unfolding Mark and place the unfolded die on a play field to cover six (6) grids which are connected to one another.

Figure 10:
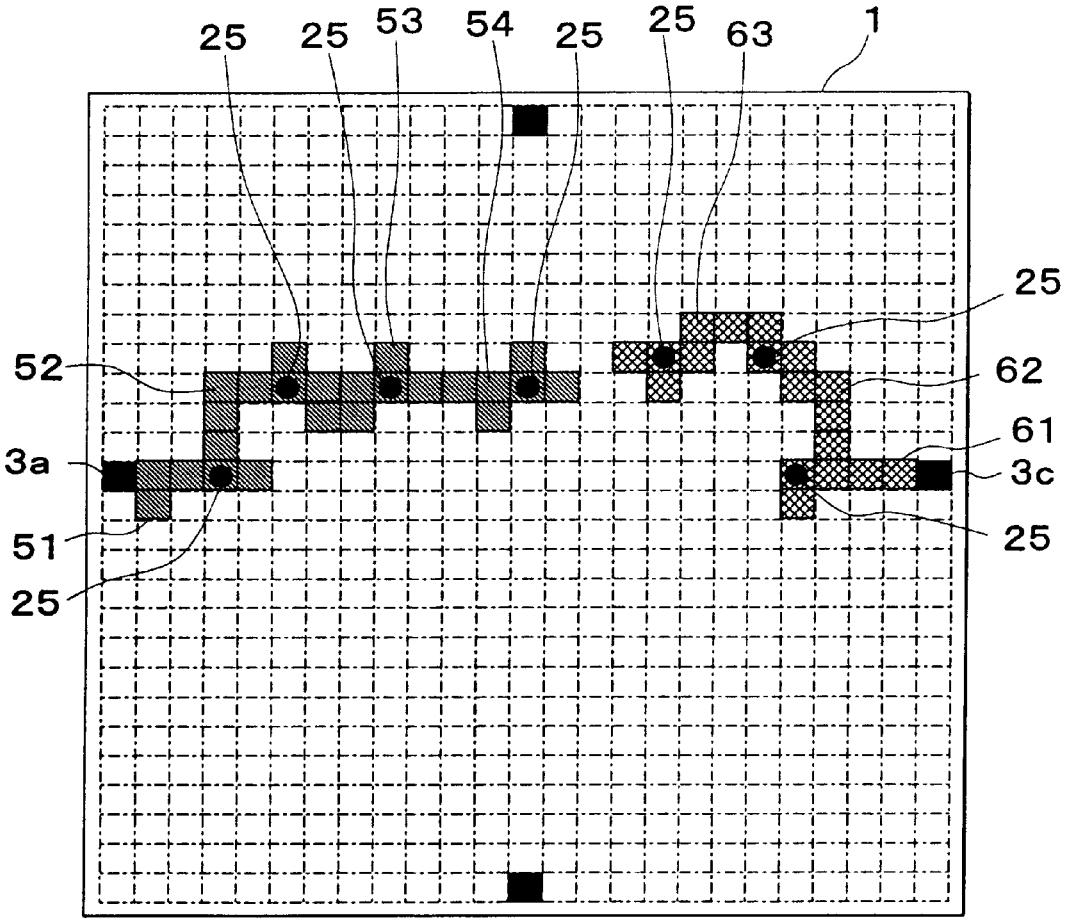
FIG. 10 is a drawing used for describing a development of a game.

As shown in FIG. 10, the unfolded dice 51–54 are those dice which were unfolded on the play field by one player and the unfolded dice 61–63 are those dice which were unfolded on the play field by the opponent. The black circles depicted on respective unfolded dice are each player's pieces 25.

When the first unfolded dice 51 and 61 are placed on the play field, the rule sets forth that the unfolded dice 51 and 61 must be placed in such a manner that one of the adjacent grids to 3*a* and 3*c* must be covered by the unfolded dice. After that the unfolded die 5 is placed in such a manner that one of such unfolded die must be set adjacent to at least one polygonal plate of the player's already-unfolded die placed on the play field and yet any polygonal plates of such unfolded die must not overlap polygonal plates of the player's or opponent's unfolded dice. As each player executes predetermined steps in each turn in order, the unfolded dice form an advancing path pattern on the play field. When the dice unfolded and placed on the play field both by the player and the opponent touch each other's die, the pieces of the player and the opponent can advance along the other's unfolded dice.

After a die is unfolded, the player chooses a piece, according to the Group and Level recognized from the three dice rolled on the rolling place, from among the pieces included in a game component set used by the player. The player then places the piece onto one of the plural polygonal plates constituting the die. In this instance the Group to which the piece belongs is indicated by the color of the outside of the polygonal plates, and the Level of the piece is indicated by the alphabetical letter written inside the Die-Unfolding Mark. And the piece selected is placed on an inside of a polygonal plate having the Position Mark. In this instance the piece is placed with the front thereof faced toward the opponent so that the player's pieces and the opponent's pieces may easily be distinguished.

In both cases when a die 5 is unfolded and not, if an Advancement Mark or an Execution Mark is included among the judgement objects on the polygonal plates of the three dice, the player save, for each kind of the mark separately, such number of costs as equal to the number of each mark. In this instance an Addition/Deduction Unit 35 as shown in FIGS. 8A and 8B is used.

In each turn when a player tries to make his/her piece wield or exert power or demonstrate ability thereof, the player pays the necessary costs from the saved costs. When a piece exists on an advancing path pattern and the costs necessary for making the piece wielding or exerting power thereof or demonstrating ability thereof are saved or possessed by the player, the player can make his/her piece advance and/or do other things. Therefore even before the direct fight between pieces starts, the player can advance his/her piece or make the piece exert specific power thereof, while working out his/her strategy. Each player decides whether or not to make each piece wield the power thereof considering the saved costs in possession. Also in the Advancement/Attack Step in the opponent's turn the rules set forth that the player can defend his/her piece or attack or destroy the opponent's piece by paying the necessary costs from the saved costs. Therefore according to such rules the player can fight against his/her opponent by wielding the full power or demonstrating the full ability of his/her piece. The rules set forth that wielding power during one turn is started using the last selected power in the adverse order.

In the condition as shown in FIG. 10, the advancing path pattern is not connected, and therefore, in principle, the piece of the player and that of the opponent cannot fight against each other. The rules set forth that when the player's piece and that of the opponent's have reached a certain positional relationship with each other after the respective pieces have been advanced along the advancing path pattern formed with the unfolded dice in order, the player can, for the first time, attack the opponent's piece or Master Piece. Typical conditions for attacking is a case in which the player's piece and that of the opponent's stand on the grids adjacent to each other. However, when a specific piece is given a power to attack the opponent's piece placed on the grid which is the m th (m is an integer of more than two) grid from the grid on which the player's piece stands, the player's piece can exceptionally attack such opponent's piece as is on the m th grid from the grid on which the player's piece stand. Also the content of the attack may be determined as a Special Ability or Power. For example, one of the Special Powers may be such as four times of the original power may be acquired by paying twice the costs, or the opponent's piece ahead in the front direction, however many grids away, may be attacked. These Special Powers may be determined in various ways and are not limited to the Special Powers described in the present specification.

When a piece is attacked, the destruction of the piece is avoided if the sum of Defending Power and the Sustaining Power is larger than the Attacking Power of the opponent's piece. However, the Sustaining Power decreases after being added to the Defending Power. The decreased value of the Sustaining Power is indicated by placing the marbles whose number is equivalent to the decreased value of the Sustaining Power. For example, if one of the player's piece having 30 points of Defending Power and 40 points of Sustaining Power is attacked by one of the opponent's piece having 40 points of Attacking Power, the Sustaining Power of the player's piece is decreased by 10 points and one (1) marble is placed on the corresponding card. When the same player's piece is attacked by the same opponent's piece three times more, the Sustaining power decreases to zero (0) and the piece is considered to have been destroyed. Attacking Power and Defending Power may basically be wielded or exerted only once during each turn by paying necessary costs. This means that if the Defending Power was wielded or exerted in the previous turn, the same Defending Power may be wielded or exerted by paying the necessary costs again in the following turn. In this instance each time the cost is paid, the pin of the Addition/Deduction Unit 35 is moved accordingly.

The rule sets forth that after a piece is destroyed (either by loosing in a fight against one of the opponent's piece or by the effect (blast) of a mine), the corresponding card is turned over, and the piece is placed on the turned-over card, or the piece is laid on the corresponding card. By doing so, still usable pieces and pieces which are not usable any more are recognizable at a glance and the player can pursue the game recognizing the opponent's usable pieces.

It is arbitrary to decide when victory or defeat is definite, but in the present example the rule sets forth that when the Master Piece has been attacked (or damaged) the predetermined number of times, it is decided that the owner (the player) of the Master Piece has lost the game.

The rules further set forth that when a piece is advanced, the player may advance his/her piece jumping over another piece of the player which stands ahead in the advancing path but may not advance his/her piece jumping over a piece of the opponent which stands ahead in the advancing path. Also in the Die-Unfolding Step the rule may sets forth that a once-destroyed piece may be revitalized if predetermined conditioned are satisfied.

In the above-described example of the present invention each piece is given both Group and Level. Each piece, of course, may be given at least one of the Group and Level.

The above example of the present invention is just an example and the present invention is not limited thereto. Also the modified, improved or varied version of the present invention naturally belongs to the technical concept of the present invention.

Effects of the Invention

According to the present invention a board game and method of play thereof which can provide an unexpected game development and more satisfaction to players is provided. Especially when a die is unfolded and form an advancing path pattern, the advancing path patterns for pieces vary each time game is played, thus the unexpectedness in a game development increases. Moreover by making players save costs during a game the present invention can provide more fun, as compared to the conventional games, to players in working out their strategies during a game. Furthermore according to the present invention pieces may be given Special Powers and the game development can be varied by making pieces wield or exert such Special Powers by paying necessary costs. Still more it is possible according to the present invention to provide an unexpected development of a game by ruling that even if a piece possesses Attacking Power or Defending Power, the piece may not wield or exert the power thereof without paying the necessary cost.

In addition by ruling how pieces and corresponding cards are placed, it is possible to provide a fair game development as still usable pieces and already-destroyed pieces (pieces considered to have been destroyed) are easy to be recognized at a glance. Moreover, according to the present invention pieces may be prepared arbitrarily, and it is possible to give players fun in acquiring various pieces and elaborating various strategies.

Also by using marbles it can be easily seen how much damage was given to each piece. Furthermore by providing write-down portions to each piece and each die it is possible to surely distinguish a player's pieces and dice from the opponent's pieces and dice and it is easy for the player to collect his/her pieces and dice to put them back in the box.

What is claimed in the present invention is:

1. A board game played by plural players comprising:

a play field having a plurality of polygon grids extending continuously and used by said plural players, and plural game component sets used by said plural players for their own play, said game component set comprising:

plural dice, plural kinds of pieces respectively having visually identifiable features and belonging to predetermined plural groups and/or predetermined levels, plural cards corresponding to said plural kinds of pieces and describing at least denominations to identify corresponding pieces, capacity or ability of the corresponding pieces, conditions for wielding or exerting said capacity or ability of said pieces, and said groups and/or said levels;

said dice being polyhedrons consisting of n (n is an integer of three or more) polygonal plates which have substantially the same dimensions with said polygonal grids of said play field and are connected in such a manner that unfolding of said dice is possible, wherein each of said polygonal plates is connected to specific adjacent polygonal plate/s in such a manner that each of said polygonal plates is so as to be connected to the/those specific adjacent polygonal plate/s when said die is unfolded two-dimensionally, wherein the outside of said polygonal plates are depicted with Die-Unfolding Mark which is a decisive factor for unfolding each of said dice, Advancement Mark which allows to save cost necessary for advancing said pieces, more that one Execution Marks which allow to save costs necessary for making said pieces to wield or exert powers thereof, and more than one Identification Mark for indicating the Group and/or Level of said pieces.

2. A board game as described in claim 1 wherein said game component set is provided, in addition, with an Addition/Deduction Unit having plural Addition/Deduction Display portions corresponding to said Advancement Mark and said more than one Execution Marks.

3. A board game as described in claim 2 wherein said game component set has plural marbles which can be placed on said cards.

4. A board game as described in claim 2 wherein more than two marks selected from said Die-Unfolding Mark, said Advancement Mark, said Execution Mark and said Identification Mark are depicted outside of one of said polygonal plates.

5. A board game as described in claim 1 wherein said Die-Unfolding Mark, said Advancement Mark, said Execution Marks and said Identification Marks are indicated by at least one of color, figure, pattern, symbol or number or letter.

6. A board game as described in claim 1 wherein a Position Mark for indicating the place on which said piece is placed, when said die is unfolded, is depicted on at least one of the inside of n said polygonal plates constituting said die.

7. A board game as described in claim 6 wherein the player can write down on said Position Mark to identify him/herself.

8. A board game as described in claim 1 wherein said piece comprises a base which is placed on said play field and a feature portion which is provided on said base and show the direction of said piece.

9. A board game as described in claim 1 or claim 6 wherein said piece is provided with a write-down portion for identifying said player.

10. A board game as described in claim 1 wherein the specific grids among said plural grids, the number of which specific grids is the same as the number of the possible players, are displayed in a distinguishable manner from the rest of grids.

11. A board game as described in claim 10 wherein a Master Piece which is placed on one of said specific grids displayed in a distinguishable manner is included in said plural pieces in said game component set.

12. A board game as described in claim 11 wherein, on said cards, said Execution Marks which is necessary for making said pieces corresponding to said cards demonstrate the ability of said pieces are depicted.

13. A board game as described in claim 1 wherein Defending Power, Attacking Power and Sustaining Power are indicated with a numeral or volume on said cards.

14. A method of play of a board game which plural players play, according to rules, comprising:

a play field having a plurality of polygonal grids extending continuously and used by said plural players, and plural game component sets used by said plural players for their own play, said game component sets comprising:

plural dice, plural kinds of pieces respectively having visually identifiable features and belonging to predetermined plural groups and/or predetermined levels, plural cards corresponding to said plural kinds of pieces and describing at least denominations to identify corresponding pieces, capacity or ability of the corresponding pieces, conditions for wielding or exerting said capacity or ability of said pieces, and said groups and/or said levels;

said dice being polyhedrons consisting of n (n is an integer of three or more) polygonal plates which have substantially the same dimensions with said polygonal grids of said play field and are connected in such a manner that unfolding of said dice is possible, wherein each of said polygonal plates is connected to specific adjacent polygonal plates in such a manner that each of said polygonal plates is so as to be connected to those specific adjacent polygonal plates when said die is unfolded two-dimensionally, wherein the outside of said polygonal plates are depicted with Die-Unfolding Mark which is a decisive factor for unfolding each of said dice, Advancement Mark which allows to save cost necessary for advancing said pieces, more than one Execution Marks which allow to save costs necessary for making said pieces to wield or exert powers thereof, and more than one Identification Marks for indicating the Group and/or Level of said pieces, said rules setting forth that each player has a turn in order and conduct during each of said turn:

(a) Die-Rolling Step-each player chooses plural dice from among his/her dice in his/her game component set and roll those dice on a dice rolling place;

(b) Die-Unfolding Step-when a Die-Unfolding Mark is respectively included among the judgement objects depicted on the outside of the polygonal plates of the predetermined number of dice, each player will unfold (or open up) two-dimensionally a die having a Die-Unfolding Mark and place the unfolded die on a play field to cover n grids which are connected to one another;

(c) Piece-Placement Step-each player chooses, according to the group and/or level recognized from the plural dice rolled on a play field, one piece from among pieces he/she owns in his/her game component set and then places the piece on one of the polygonal plates constituting said unfolded die;

(d) Cost-Saving Step-both when a die is unfolded and when not, each player can save the number of marks which appear as cost for each mark, said marks may be Advancement Marks and/or Execution Marks when such marks are included among the judgement objects depicted on the outside of the polygonal plates of dice;

(e) Advancement/Attack Step-each player advances a piece on the play field and/or make a piece wield or exert power to attack or destroy one of the opponent's pieces by paying the predetermined cost from among the saved costs; and (f) Closing-Step-each player ends his/her turn after carrying out Advancement Step and/or Attack Step or without carrying out those steps.

15. A method of play of a board game as described in claim 14 wherein said rules set forth that a player can defend his/her own piece or attack or destroy said piece of said opponent by paying said costs saved during said Advancement/Attack Step during said turn of said opponent.

16. A method of play of a board game as described in claim 15 wherein such a number of specific grids as same as the number of possible players are depicted distinguishably from the rest of the grids, and said game component set includes a Master Piece which is placed on said one of said specific grids depicted distinguishably from the rest of the grids, and wherein the rules set forth said Master Piece is placed on one of said specific grids depicted distinguishable from the rest of the grids at the beginning of a game and said Master Piece is given only Attacking Power and Sustaining Power.

17. A method of play of a board game as described in claim 16 wherein, said rules set forth that in the first time of said Piece-Placement Step, said die unfolded two-dimensionally is placed to cover at least one of the grids which are adjacent to said specific grid on which said Master Piece is placed, and in the subsequent Piece-Placement Steps said die unfolded two-dimensionally is placed in such a manner that each of the polygonal plates of said die does not overlap each of the polygonal plates of said dice which are already unfolded and placed on the play field by a player and yet at least one of the polygonal plates of said die is placed to cover one of the grids adjacent to the grids covered by the dice which are already unfolded and placed on the play field.

18. A method of play of a board game as described in claim 17 wherein said rules set forth that said dice unfolded and placed on the play field form an advancing path pattern along which a player advances his/her piece and when the player's piece and the opponent's piece are in a certain positional relationship the player can attack said opponent's piece or Master Piece.

19. A method of play of a board game as described in claim 18 wherein said pieces include Attacking-type pieces which are given Defending Power, Attacking Power and Sustaining Power and Effect Demonstrating-Type pieces which only demonstrate predetermined effects against the opponent's pieces, and wherein Defending Power, Attacking Power and Sustaining Power are indicated with numerals or volume on said cards corresponding to said Attacking-Type pieces as well as costs necessary for wielding or exerting said powers and/or demonstrating said effects.

20. A method of play of a board game as described in claim 19 wherein the rules set forth that predetermined amount of said Sustaining Power of a player's piece under attack decreases by the Attacking Power of said piece of said opponent which surpasses said Defending Power of the player's piece and that when said Sustaining Power decreases to zero, the player's piece is considered to have been destroyed.

21. A method of play of a board game as described in claim 16 or claim 20 wherein the rules set forth that when said Master Piece incurs a predetermined damage, it is determined that the owner of said Master Piece has lost the game.

22. A method of play of a board game as described in claim 17 wherein said game component sets includes a plurality of marbles which can be placed on said cards, and when Sustaining Power of said pieces decrease by the damage incurred, specific number of marbles corresponding to the decreased Sustaining Power are placed on said card corresponding to said pieces.

23. A method of play of a board game as described in claim 14 wherein the rules set forth that said pieces are placed on said cards corresponding to said pieces until said pieces are placed on unfolded dice on the play field, and after said pieces are destroyed in a game, said corresponding cards are turned over and said pieces are placed on the turned-over cards or said pieces are laid on said corresponding cards.

24. A method of play of a board game as described in claim 14 wherein said game component set includes an Addition/Deduction Unit having Addition/Deduction Display portions corresponding to said Advancement Mark and said more than one Execution Marks, and, wherein, during said Cost-Saving Step, each time said Marks appear, an addition is made at Addition/Deduction Display portions corresponding to such Marks, and during said Advancement/Attack step, a deduction is made at Addition/Deduction Display portions corresponding to said costs paid for actions taken.

25. A method of play of a board game as described in claim 24 wherein the rules set forth that the maximum number of costs saved is the number possibly added on said Addition/Deduction Unit.

26. A method of play of a board game as described in claim 24 wherein said Execution Marks include Attack Mark which indicates that a player can save a cost for attacking, Defence Mark which indicates that a player can save a cost for defending against the attack by the opponent's piece and more than one Special Ability Marks which indicate that a player can save costs necessary for making said pieces demonstrate predetermined Special Ability, and wherein on said Addition/Deduction Unit said Advancement Mark, said Attack Mark and said more than one Special Ability Marks are depicted adjacent to corresponding respective portion of said Addition/Deduction Display portions.

27. A method of play of a board game as described in claim 26 wherein the rules set forth that said Advancement Mark, said Attack Mark, said Defence Mark and said more than one Special Ability Marks are depicted with figures or diagrams and that when a numeral, a letter or a symbol is depicted near or inside such figures or diagrams, costs which can be saved with such marks are the number indicated by said specific numeral, letter or symbol.

28. A method of play of a board game as described in claim 14 wherein said Die-Unfolding Mark is depicted on the surface of one of said polygonal plates together with said Identification Mark indicating said Group and said Level to which said piece belongs to.

29. A method of play of a board game as described in claim 14 wherein the rules set forth that in said Dice-Rolling Step more than three of said dice are selected for rolling.

30. A method of play of a board game as described in claim 14 wherein the pattern of said dice when unfolded varies and plural patterns of said dice unfolded are classified into plural kinds of patterns.

31. A method of play of a board game as described in claim 14 wherein the number of said plural dice and said plural kinds of pieces prepared in a game component set is the number decided in the rules, nevertheless said plural dice and said plural pieces are selected by a player from among his/her own stock of dice and pieces.

* * * * *

UNITED STATES PATENT AND TRADEMARK OFFICE

CERTIFICATE OF CORRECTION

PATENT NO. : 6,585,265 B2
DATED : July 1, 2003
INVENTOR(S) : Shoji Dewa et al.

It is certified that error appears in the above-identified patent and that said Letters Patent is hereby corrected as shown below:

Column 14,
Line 63, please delete "claim 2", and insert therefor -- claim 3 --.

Signed and Sealed this

Thirteenth Day of January, 2004

JON W. DUDAS
*Acting Director of the United States Patent and Trademark Office*